US007832487B2

(12) United States Patent
Jensen et al.

(10) Patent No.: US 7,832,487 B2
(45) Date of Patent: Nov. 16, 2010

(54) CASING STABBING GUIDE

(75) Inventors: Kenneth C. Jensen, Rocky View (CA); Radovan Tepavac, Calgary (CA); Milan Cerovsek, Calgary (CA)

(73) Assignee: Tesco Corporation, Houston, TX (US)

( * ) Notice: Subject to any disclaimer, the term of this patent is extended or adjusted under 35 U.S.C. 154(b) by 99 days.

(21) Appl. No.: 12/060,744

(22) Filed: Apr. 1, 2008
(Under 37 CFR 1.47)

(65) Prior Publication Data

US 2009/0242192 A1 Oct. 1, 2009

(51) Int. Cl.
*E21B 19/16* (2006.01)

(52) U.S. Cl. ..... 166/380; 166/77.51

(58) Field of Classification Search ..... 166/378, 166/380, 77.51, 85.1; 29/272; 285/27
See application file for complete search history.

(56) References Cited

U.S. PATENT DOCUMENTS 3,475,038 A * 10/1969 Lee ..... 285/27
3,576,062 A * 4/1971 Matherne ..... 29/281.6
4,213,237 A * 7/1980 Whiting ..... 29/272
4,533,162 A * 8/1985 Rundell ..... 285/27
4,599,778 A * 7/1986 Dreyfuss et al. ..... 29/272
4,654,950 A * 4/1987 Maidlow ..... 29/428
4,667,752 A 5/1987 Berry et al.
5,755,289 A * 5/1998 Angman et al. ..... 166/378
7,128,161 B2 10/2006 Pietras
7,237,607 B2 * 7/2007 Angman et al. ..... 166/85.5
7,490,677 B2 * 2/2009 Buytaert et al. ..... 166/380
2006/0000601 A1 * 1/2006 Pietras ..... 166/77.53
2006/0124305 A1 * 6/2006 Juhasz et al. ..... 166/285

OTHER PUBLICATIONS

International Search Report and Written Opinion, PCT/US2009/038716, dated Mar. 30, 2009.

* cited by examiner

*Primary Examiner*—Daniel P Stephenson
*Assistant Examiner*—Kipp C Wallace
(74) *Attorney, Agent, or Firm*—Bracewell & Giuliani LLP

(57) ABSTRACT

A stabbing guide connects to a casing collar during makeup. The stabbing guide has a housing with a lower portion with a cylindrical interior and an upper portion with a conical interior. Upper and lower shoulders are located in the cylindrical interior, defining an annular recess between the shoulders. Each of the shoulders has an inner diameter smaller than an outer diameter of the casing collar. The housing is formed in separate segments and secured around the casing collar by a clamp.

14 Claims, 4 Drawing Sheets

CASING STABBING GUIDE

FIELD OF THE INVENTION

This invention relates in general to deploying well casing with a top drive having a casing gripper, and in particular to a protective stabbing guide that is mounted to the casing collar of the casing pipe during make-up.

BACKGROUND OF THE INVENTION

Many wells for oil and gas production are drilled by using a string of drill pipe drilled to a selected depth. Then the operator retrieves the drill pipe and runs casing into the well bore, which is then cemented to line the well bore. In another technique, rather than using drill pipe, the operator uses the string of casing as the drill string. When reaching the proper depth, the operator cements the casing string in the well.

A joint of drill pipe is a steel pipe with an externally threaded end and an internally threaded end. Drill pipe is thick-walled and designed for being made up and broken out many times. A joint or section of casing is a pipe with a thinner wall and designed to be made up only a few times at most. Normally, both ends of the casing joint are externally threaded, and a casing collar is secured to one of the ends. The casing collar has internal threads for connecting to the external threads of the adjacent casing joint.

There are also two different ways to rotate a drill string, either by a kelly bushing or by a top drive. The kelly-bushing technique imparts rotation to the drill string by causing the powered rotary table to rotate a square, tubular kelly attached to the top of a string of drill pipe. This technique is used only when drilling with drill pipe. Another technique is to use a top drive, which can be used both for casing drilling or drill pipe drilling. The top drive includes a power source, such as a hydraulic or electrical motor, that imparts rotation to the drill string and moves up and down the derrick. The top drive has a quill that it rotates, and either the string of drill pipe or the string of casing is connected to the quill. For casing drilling, the operator attaches a casing gripper to the quill. The casing gripper has grapples that when actuated either grip the inside or the exterior of the string of casing to impart rotation and also support the weight of the casing. Top drives with casing grippers can also be employed to run casing in well bores that have been drilled with conventional drill pipe.

Whether running casing in a previously drilled well or drilling with casing, the operator of a top drive rig uses basically the same technique. The casing already deployed is suspended by slips at the rotary table. The operator picks up a new joint or section of casing pipe, typically with a set of elevators, which comprises a clamp-like device that is carried on bails attached to the top drive assembly. The operator places the elevators around the new joint of casing, then picks the casing joint up with the top drive. The operator stabs the lower end of the casing joint into the upper end of the casing string suspended by the slips. The operator lowers the casing gripper into the casing collar at the upper end of the casing joint to be attached, then actuates the gripper to grip the pipe. The operator then rotates the top drive to secure the upper joint of casing to that suspended in the well. The operator then lifts the entire string with the top drive and either begins drilling or lowers the entire string if running casing.

While running and drilling with casing have many advantages, there is a risk that the internal threads in the casing collar at the upper threaded end of the casing joint being lifted will be damaged by the casing gripper as the gripper enters the casing collar. The casing gripper is inserted while the casing collar is suspended above the rig floor the length of the joint, which may be 30 to 40 feet. Consequently it is difficult for the driller to guide the casing gripper into the casing collar.

SUMMARY OF THE INVENTION

In this invention, a casing stabbing guide is provided. The guide comprises a housing having a lower portion with a cylindrical interior and an upper portion with a conical interior. Upper and lower shoulders are located in the cylindrical interior, defining an annular recess between the shoulders. Each of the shoulders has an inner diameter selected to be smaller than an outer diameter of the casing collar. The annular recess has an inner diameter selected to be larger in diameter than an outer diameter of the collar. The housing is formed in separate segments and clamped around the casing collar, with the collar located in the annular recess.

When used with a top drive drilling rig having a casing gripper, the casing stabbing guide is clamped to the casing collar of the casing joint before it is lifted by the top drive. The elevators of the top drive assembly are positioned around the casing pipe below the casing stabbing guide. The operator then raises the top drive to lift the casing joint along with the casing stabbing guide. In the embodiment shown, the operator then stabs the lower end of the casing joint into the casing collar at the top of the string of casing suspended in the rotary table. The operator then lowers the top drive casing gripper into the casing stabbing guide at the upper end of the casing joint, with the casing stabbing guide protecting the threads when this occurs. The operator then rotates the top drive to make up the lower end of the upper casing joint with the casing suspended in the slips. The operator raises the entire casing string, disengages the slips and begins lowering the entire casing string, either to drill or run casing.

The stabbing guide remains on the upper joint as the upper joint is lowered, either during drilling or when running casing. When the stabbing guide nears the slips at the rig floor, the slips are actuated to grip the upper joint of casing below the stabbing guide. While the casing stabbing guide could be removed at this point, preferably it remains just above the slips to serve as a stabbing guide for the lower end of the next joint of casing to be connected to the casing string. A second casing stabbing guide is connected to the casing collar of the next casing joint to be connected. The stabbing guide thus serves not only to protect the threads when the upper casing joint is made up to the casing gripper, but also protects the threads when the upper casing joint is stabbed into the string of casing supported at the rotary table. Casing guides of various types have been used for the upper end of the casing string suspended at the slips. These guides would not be suitable for mounting to the casing collar of a casing joint to be lifted by a top drive and engaged by a casing gripper.

DETAILED DESCRIPTION OF THE INVENTION

Figure 1:
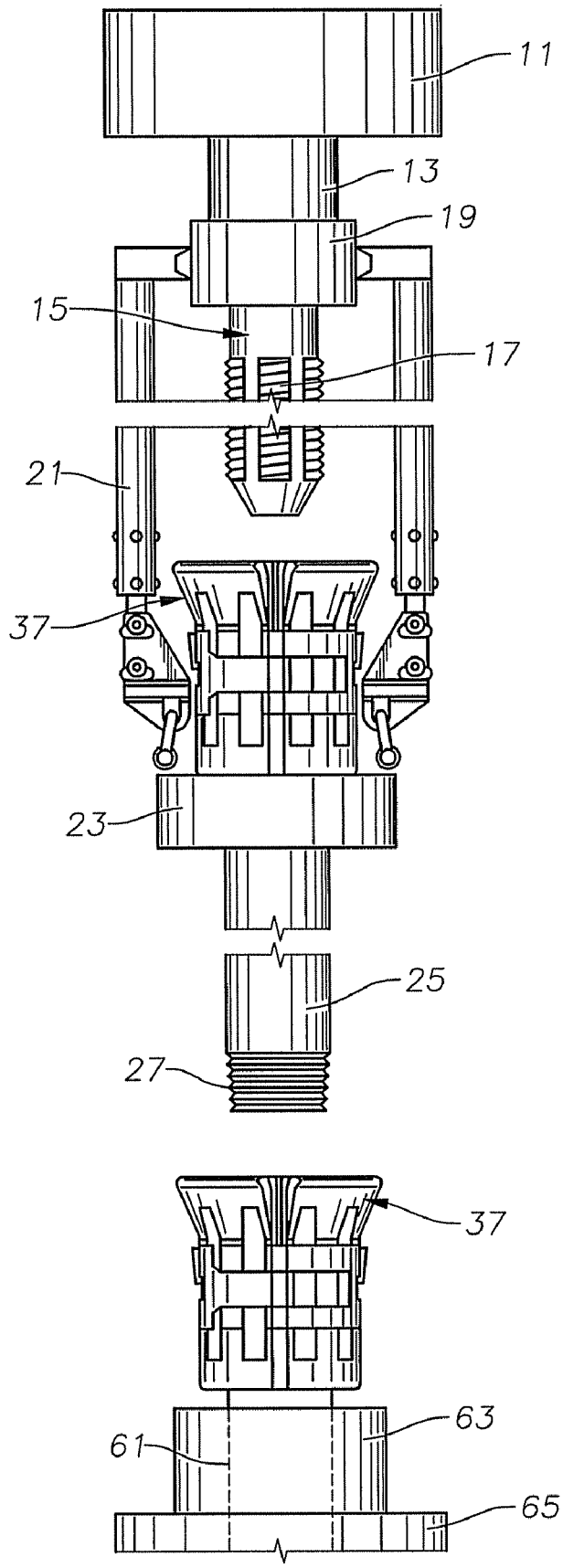
FIG. 1 is a schematic view illustrating a step of the invention employing two stabbing guides constructed in accordance with this invention.

Referring to FIG. 1, a drilling rig having a top drive 11 is illustrated schematically. Top drive 11 is powered either hydraulically or electrically and rotates a quill 13. Top drive 11 is moved up and down a derrick by blocks (not shown).

An internal casing gripper 15 is shown secured to quill 13. Casing gripper 15 may be of a variety of types. Typically, it has grapples 17 that expand radially outward when actuated by an actuator 19. Actuator 19 may be hydraulic, electrical or pneumatic, and typically does not rotate with grapples 17. In this example, the top drive assembly also includes a pair of elevator bails 21 that are suspended preferably by casing gripper actuator 19. Elevator bails 21 pivotally support a set of elevators 23, which is conventional and comprises two halves that are hinged together and fit slidably around a string of pipe, such as upper pipe 25. Elevators 23 resemble a clamp, but typically fit loosely around pipe rather than gripping pipe.

Upper pipe 25 is a section or joint of casing that will eventually be cemented in the well to line the well. Upper pipe 25 has a lower externally threaded end 27 that is normally slightly tapered as shown. Also, referring to FIG. 3, upper pipe 25 in this example has an upper threaded end 29 that is identical to lower threaded end 27. A casing collar 31 is secured to upper threaded end 29. Casing collar 31 comprises a sleeve having lower internal threads 33 that make up with upper threaded end 29. Casing collar 31 also has a set of upper internal threads 35 for making up with the threads on the lower end of another joint of pipe. A portion of casing collar 31 thus protrudes above the upper end of pipe 25. Although casing collar 31 is illustrated as being attached to pipe 25 by threads 29, 33, it could be attached in other manners, such as welding, or casing collar 31 could be integrally formed on pipe 25.

Figure 3:
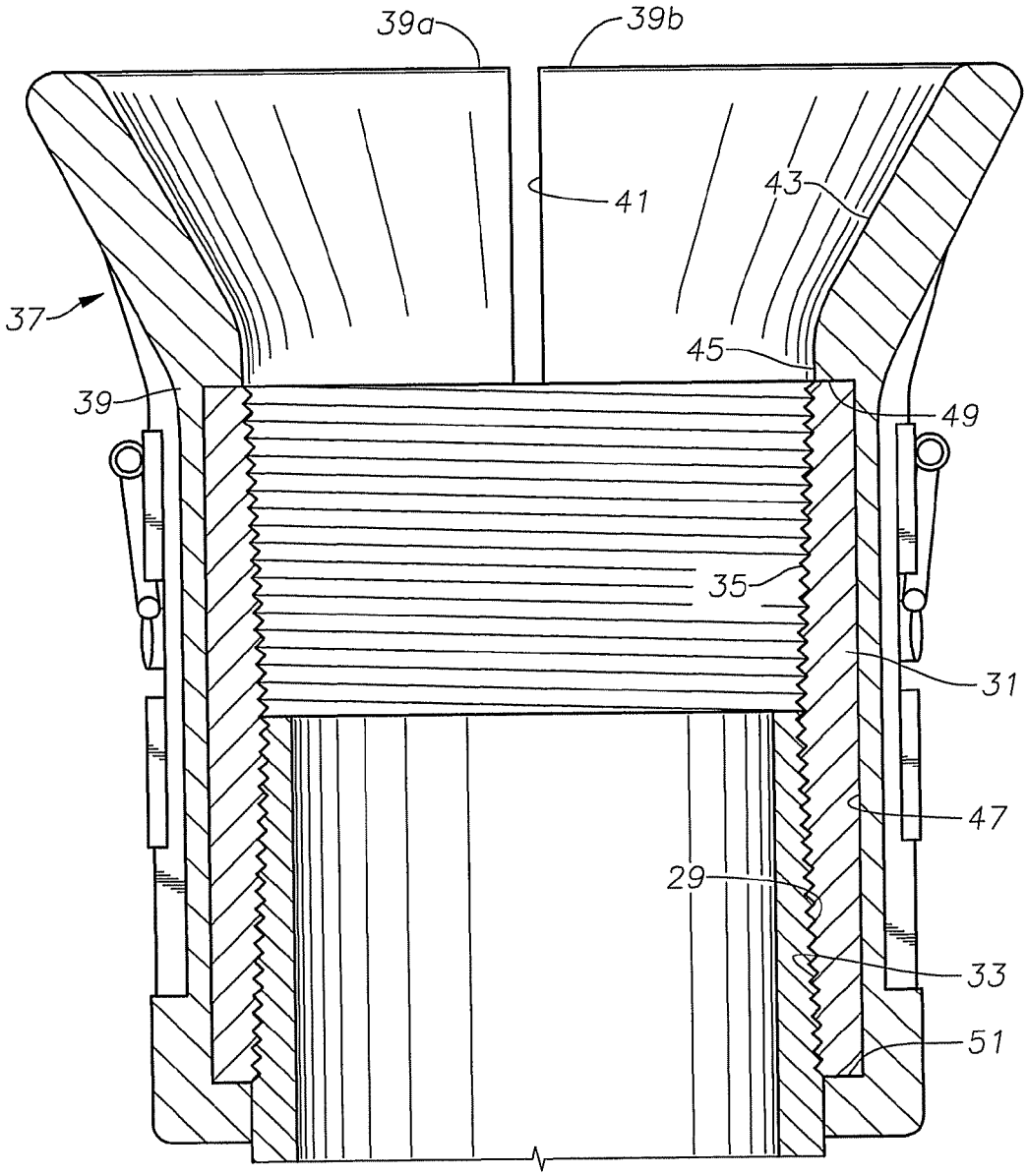
FIG. 3 is an enlarged sectional view illustrating one of the stabbing guides of FIG. 1.
Figure 5:
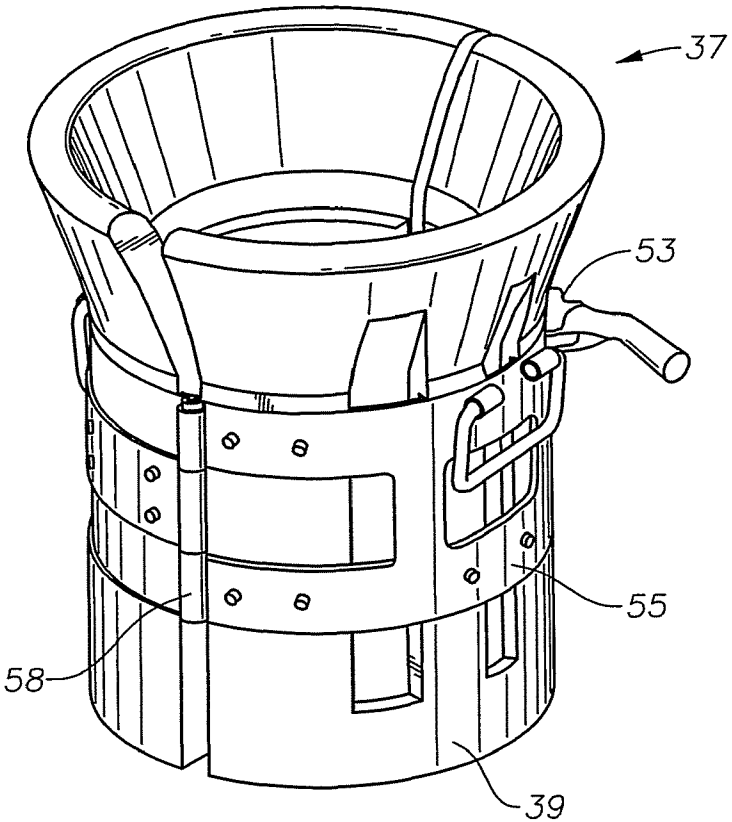
FIG. 5 is another perspective view of one of the stabbing guides of FIG. 1.

Referring still to FIG. 3, a stabbing guide 37 is shown mounted on casing collar 31. Stabbing guide 37 comprises a housing 39 that is preferably split into two semi-cylindrical halves 39*a* and 39*b* secured together by a hinge 58 (FIG. 5). When clamped around collar 31, the edges of halves 39*a* and 39*b* opposite hinge 58 are normally separated from each other by a longitudinal or axially extending split 41. Housing 39 may be constructed of a high impact plastic material or of lightweight metal. Housing 39 has a conical interior 43 on its upper end that defines a funnel. The minimum inner diameter of conical interior 43 is substantially equal to the inner diameter of casing collar 31. The maximum inner diameter of conical interior 43 is preferably larger than the outer diameter of casing collar 31. Conical interior 43 is located entirely above casing collar 31 while mounted to it.

Stabbing guide 37 also has a cylindrical interior 45 that extends downward from conical interior 43. Cylindrical interior 45 has an annular recess 47, which has an inner diameter that is slightly larger than the outer diameter of casing collar 31 so that it will fit closely around casing collar 31. Annular recess 47 has an upper stop shoulder 49 at its upper end and a lower stop shoulder 51 at its lower end. The distance between shoulders 49, 51 defines the length of axial recess 47, and this length is slightly greater than the length of casing collar 31. Stop shoulders 49, 51 in this embodiment are located in planes perpendicular to the longitudinal axis of stabbing guide 37, but could be tapered, if desired. The inner diameter of upper stop shoulder 49 is substantially flush with the inner diameter of casing collar 31 at its upper end. The inner diameter of lower stop shoulder 51 is only slightly greater than the outer diameter of pipe 25 immediately below threaded upper end 29. In this example, the inner diameters of stop shoulders 49 and 51 are the same. The radial thickness of each shoulder 49, 51 is approximately the same as the thickness of casing collar 31 at its upper and lower ends. When clamped around collar 31, stop shoulders 49, 51 prevent any substantial axial movement of stabbing guide 37 relative to casing collar 31.

Figure 4:
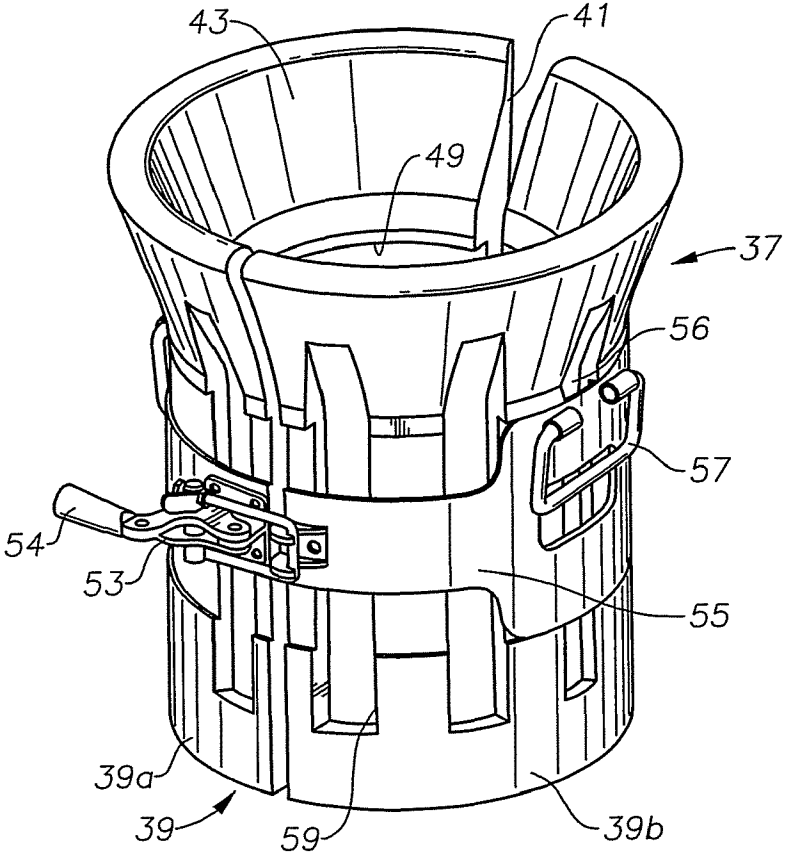
FIG. 4 is a perspective view of one of the stabbing guides of FIG. 1.

Referring to FIG. 4, a clamp 53 is used to releasably retain housing halves 39*a*, 39*b* together in a cylindrical configuration. A variety of clamps could be employed for clamp 53. In this example, clamp 53 has a handle 54 for quick access by a worker. Also, clamp 53 is attached to a band 55 that encircles housing segments 39*a*, 39*b*. Band 55 is split into two halves, and hinge 58 (FIG. 5) attaches the two halves of band 55 at a point opposite clamp 53. Band 55 is preferably metal, such as steel and may have handles 57 for lifting stabbing guide 37. The two halves of band 55 may be attached to their respective segments 39*a*, 39*b* by fasteners. Retaining shoulders 56 may be located above and below portions of each half of band 55 to prevent axial slippage of band 55. When clamped around casing collar 31, it is not necessary for housing 39 to tightly grip casing collar 31.

In this example, a plurality of external channels 59 are formed on the exterior of housing 39, each spaced circumferentially apart from the other. Channels 59 reduce the amount of material used in the cylindrical portion of housing 39. Although each channel 59 is shown as having a closed base, they could alternately be open to the interior of housing 39.

Referring to FIG. 1, one of the stabbing guides 37 is shown clamped to the upper end of an upper pipe 25 that is being positioned to be connected to the string of casing 61 suspended by power slips 63 on rotary table 65. Also, an identical stabbing guide 37 is shown clamped to the upper end of the string of casing 61. In operation, whether running casing or drilling with casing, the operator will add an upper pipe 25 by first clamping stabbing guide 37 around its casing collar 31 (FIG. 3) before it is picked up by top drive 11. Before upper pipe 25 is lifted, workers at the rig floor will have access to the upper end of upper pipe 25 because pipe 25 will be supported at an inclination by a V-board or by other pipe handling equipment. The driller and the workers then position elevators 23 around upper pipe 25 below stabbing guide 37. Elevators 23 may be manually or power actuated and need not grip pipe 25. Rather, elevators 23 will slide up and abut the lower end of stabbing guide 37 as the driller begins to lift upper pipe 25 with top drive 11. The driller will then lift top drive 11 until upper pipe 25 is vertically above string of casing 61. Casing gripper 15 will be located above stabbing guide 37 of upper pipe 25. The string of casing 61 will normally have a stabbing guide 37 mounted to it, as well, although it optionally could be removed.

In one technique, the operator then lowers top drive 11 until lower threaded end 27 of upper pipe 25 stabs into engagement with upper threads 35 of casing collar 31 (FIG. 3). In this example, elevators 23 slide downward on upper pipe 25 because it is supported by the string of casing 61 at that point. Continued lowering of top drive 11 causes casing grippers 15 to pass through stabbing guide 37 on upper pipe 25. When grapples 17 are located within the interior of upper pipe 25, the operator actuates actuator 19, causing grapples 17 to expand outward and grip the inner wall of upper pipe 25.

Figure 2:
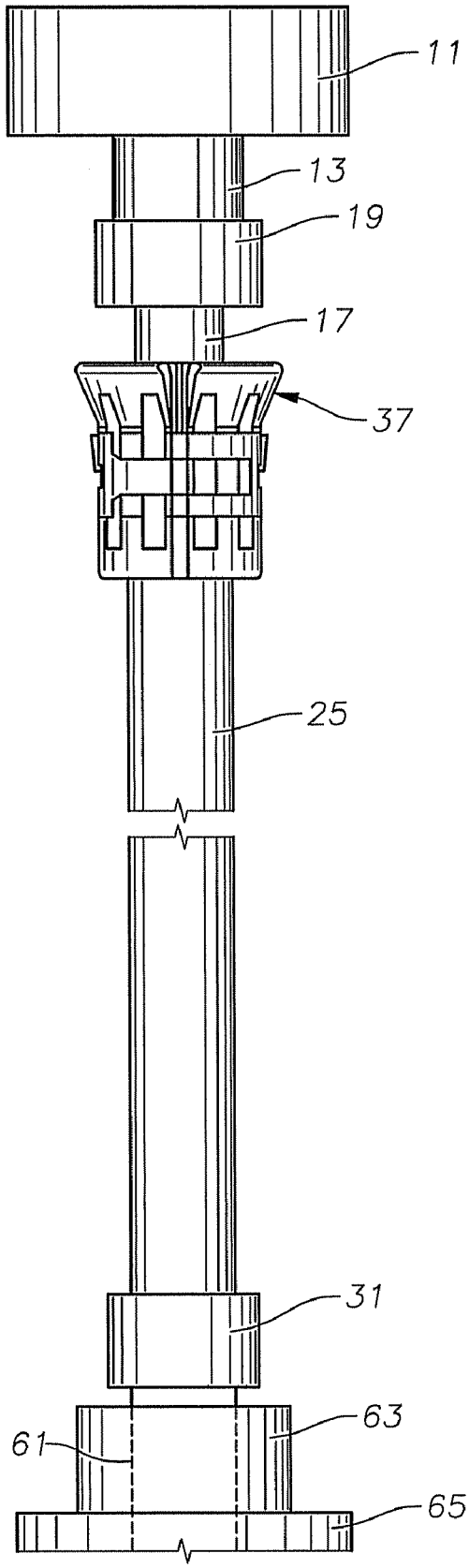
FIG. 2 is a schematic view of a subsequent step of the invention, wherein the lower stabbing guide has been removed and the string of casing has been lowered into the well.

The operator then rotates top drive quill 13, which causes upper pipe 25 to rotate and make up threaded engagement with the string of casing 61. The operator then picks up the entire string of casing 61 with top drive 11 and removes the lower stabbing guide 37 previously located at the upper end of the string of casing 61. This is the position shown in FIG. 2.

The operator then proceeds to lower the entire string of casing 61 while the upper stabbing guide 37 remains attached to the upper end of upper pipe 25. If the operator is drilling, he will rotate upper pipe 25 along with stabbing guide 37. Elevators 23 (FIG. 1) are not shown in FIG. 2, and when they near the rig floor, they are released and pivoted out of the way. When stabbing guide 37 nears slips 63, the operator will actuate slips 63 and repeat the process. While the operator could remove stabbing guide 37 easily once it is near the rig floor, preferably, it will remain in place to serve as a stabbing guide for next upper pipe 25 to be connected into the casing string 61.

The stabbing guide reduces the chance of the casing gripper damaging the threads as the casing gripper moves downward into the pipe. The stabbing guide can also protect the stabbing of a casing joint into the upper end of a string of casing supported at the rig floor. The stabbing guide readily attaches and removes from the casing.

While the invention has been shown in only one of its forms, it is should be apparent to those skilled in the art that it is not so limited but susceptible to various changes without departing from the scope of the invention. For example, when making up the casing gripper to the top drive quill, the elevator bails could be telescoping and powered so as to lift the upper pipe casing upward into engagement with the quill while the top drive remains stationary. This arrangement would allow the operator to grip the upper casing pipe with the casing gripper before the lower end of the upper casing pipe is stabbed into the upper end of the casing string suspended at the rig floor.

The invention claimed is:

1. A well casing assembly, comprising:

a housing having a longitudinal axis, a lower portion with a cylindrical interior and an upper portion with a conical interior;

a plurality of external longitudinally extending channels formed in an exterior of the housing, the channels being circumferentially spaced apart from each other around a circumference of the housing;

upper and lower shoulders in the cylindrical interior, defining an annular recess between the shoulders, each of the shoulders having an inner diameter selected to be smaller than an outer diameter of a casing collar, the annular recess having an inner diameter selected to be larger than an outer diameter of the casing collar;

the housing being formed in two separate housing segments;

an annular band with a cylindrical exterior extending around the housing over at least part of the channels, the band being formed in two separate band segments, each band segment being attached to one of the housing segments;

a hinge connected between the band segments to allow the housing to be moved between open and closed positions; and a clamp secured to the annular band for clamping the housing segments together around the collar.

2. The assembly according to claim 1, a retaining shoulder on the exterior of each housing segment in abutment with an upper end of each band segments.

3. The assembly according to claim 1, wherein each shoulder is located in a plane perpendicular to an axis of the housing.

4. The assembly according to claim 1, wherein the upper portion has an inner diameter at its lower end that is equal to an inner diameter of the lower portion.

5. The assembly according to claim 1, wherein the inner diameters of the shoulders are the same.

6. A well casing and installation assembly, comprising:

first and second pipes, each having upper and lower external threaded ends;

a first casing collar having a lower set of internal threads secured to the upper external threaded end of the first pipe and an upper set of internal threads for engaging the lower external threaded end of the second pipe;

first and second protective housings, each formed in segments, the housings being releasably clamped around the first and second casing collars, respectively, the first protective housing protecting the upper set of internal threads of the first casing collar as the lower external threaded end of the second pipe is lowered into the first casing collar, each of the housings having a lower portion with a cylindrical interior and an upper portion with a conical interior; and an annular recess in the cylindrical interior in each of the housings that fits closely around one of the casing collars, stop shoulders at upper and lower ends of each of the recesses that are spaced apart greater than a length of each of the casing collars, and the stop shoulders extending inward for limiting axial movement of the housings relative to the casing collars while clamped around the casing collars;

a top drive for lifting the second pipe and suspending it above the first pipe;

a casing gripper secured to the drilling rig top drive and having grapples inserted through the second protective housing into and gripping an interior of the second pipe, the second protective housing protecting the upper set of internal threads of the second casing collar from the grapples during insertion; and an elevator suspended on links from the casing gripper and clamped around the second pipe for lifting the second pipe, the elevator having an upper end that abuts a lower edge of the second protective housing while the top drive is lifting the second pipe.

7. The assembly according to claim 6, wherein the stop shoulders in each of the protective housings extend circumferentially around the cylindrical interior.

8. The assembly according to claim 6, wherein the stop shoulder at the upper end of the recess in each of the protective housings defines an inner diameter substantially equal to an inner diameter of each of the casing collars at an upper end of each of the casing collars.

9. The assembly according to claim 6, wherein the stop shoulder at the lower end of the recess of each of the protective housings defines an inner diameter substantially equal to an outer diameter of the first pipe below the first casing collar and the second pipe below the second casing collar.

10. The assembly according to claim 6, wherein there are two of the segments of each of the protective housings.

11. The assembly according to claim 6, wherein each of the shoulders of the first protective housing has a thickness substantially equal to a thickness of the first casing collar at upper and lower ends of the first casing collar.

12. A method of attaching an upper casing pipe to a string of well casing pipes suspended by slips of a drilling rig, the drilling rig having a top drive, an internal casing gripper, and an elevator suspended on bails, each of the casing pipes having a lower external threaded end and a casing collar having internal threads at an upper end, the method comprising:

(a) providing at least one housing having a lower portion with a cylindrical interior and an upper portion with a conical interior, the cylindrical interior in the housing having upper and lower shoulders, defining an annular recess between the shoulders;

(b) clamping the housing around the casing collar of the upper casing pipe, with the upper shoulder above an upper end of the casing collar and the lower shoulder below a lower end of the casing collar; then (c) clamping the elevator around the upper pipe and lifting the upper casing pipe with the top drive and supporting the upper casing pipe above the string of well casing pipes, the elevator having an upper end that abuts a lower end of the housing when the top drive is lifting the upper casing pipe;

(d) stabbing the lower threaded end of the upper casing pipe into engagement with the casing collar at the upper end of the string of well casing pipes; then (e) lowering the top drive and the internal casing gripper relative to the upper pipe and stabbing the internal casing gripper through the conical interior of the housing and gripping the upper casing pipe; then (f) rotating the top drive to engage the lower threaded end of the upper casing pipe with the casing collar at the upper end of the string of well casing pipes; then (g) releasing the slips from the string of well casing pipes and lowering the string of well casing pipes, along with the upper pipe, into the well.

13. The method according to claim 12, further comprising:

before step (d), clamping a second one of the housings around the casing collar at the upper end of the string of well casing pipes;

guiding the lower end of the upper casing pipe into engagement with the casing collar at the upper end of the string of well casing pipes with the second one of the housings; and before step (g), removing the second one of the housings from the casing collar at the upper end of the string of well casing pipes.

14. The method according to claim 12, wherein step (g) comprises rotating the string of well casing pipes with the top drive and performing drilling with the string of well casing pipes while the housing remains attached to and rotates with the upper casing pipe.

* * * * *